United States Patent [19]

Mulcahy

[11] 4,130,066

[45] Dec. 19, 1978

[54] FRICTION SIDE BEARING ASSEMBLY

[75] Inventor: Harry W. Mulcahy, Griffith, Ind.

[73] Assignee: Amsted Industries Incorporated, Chicago, Ill.

[21] Appl. No.: 797,519

[22] Filed: May 16, 1977

[51] Int. Cl.[2] ..... B61F 5/14; B61F 5/24; F16C 17/04; F16C 27/02

[52] U.S. Cl. ..... 105/199 CB; 308/138

[58] Field of Search ..... 105/199 CB; 308/138

[56] References Cited

U.S. PATENT DOCUMENTS

| | | | |
|---|---|---|---|
| 2,259,049 | 10/1941 | Swan et al. | 308/138 |
| 2,327,954 | 8/1943 | Barrows et al. | 308/138 |
| 2,350,301 | 5/1944 | Cottrell | 308/138 |
| 2,830,857 | 4/1958 | Blattner | 308/138 |
| 3,981,548 | 9/1976 | MacDonnell et al. | 105/199 CB |

*Primary Examiner*—Albert J. Makay
*Assistant Examiner*—Howard Beltran
*Attorney, Agent, or Firm*—John L. Schmitt; Fred P. Kostka

[57] ABSTRACT

An improved railroad car truck side bearing assembly comprising two spring means spaced apart in a manner so as to concentrically envelop the side bearing mounting holes of a railroad car truck bolster; a base for mounting to a railroad car truck bolster and having pockets at each of its longitudinal extremities for receiving one end of a spring means so as to retain the spring means in its desired location, the base further having a centrally located upstanding projection partially enveloping the two spring means and also provided with a side wall having angularly and laterally disposed surfaces; a cap having pockets in its longitudinal extremities to receive and retain the other ends of the spring means, the cap having a pair of centrally located depending members which co-operatively interengage the projection of the base, the cap also being provided with a side wall having angularly and laterally disposed surfaces to co-operatively engage the similar surfaces located on the base.

4 Claims, 5 Drawing Figures

FRICTION SIDE BEARING ASSEMBLY

This invention relates to railroad car truck side bearings. More particularly, this invention relates to improved spring loaded railroad car truck side bearings adapted to be mounted on truck bolsters.

Constant contact side bearings are commonly used on railroad car trucks. For example, such side bearings are known which have associated therewith a single, helical spring. However, prior experience with such spring loaded constant contact type side bearings have indicated deficiencies, for example, in the fatigue life of the spring. Difficulties have also been present in inspection of these springs due to the lack of visibility in their installed location. A further major drawback in attempting to redesign the spring to increase life expectance without severely reducing load carrying capabilities is the lack of an adequate spring envelope. Clearly, it would be desirable to provide an improved spring loaded side bearing for use in railroad car trucks.

Therefore, the primary object of the present invention is to provide an improved railroad car truck side bearing assembly.

Another object of the present invention is to provide a railroad car truck side bearing having an improved, i.e., longer, useful life.

An additional object of the present invention is to provide an improved railroad car truck side bearing assembly that may be easily incorporated into a conventional railroad vehicle to, for example, minimize the incorrect truck swiveling and nosing. These and other objects of the present invention will become apparent hereinafter.

An improved railroad car truck side bearing assembly has now been discovered. This assembly comprises two spring means, preferably double coil concentric springs, spaced apart in a manner as described hereinafter; a base, disposed for mounting to a railroad car truck bolster with its longitudinal axis substantially perpendicular to the longitudinal axis of the truck bolster and having pockets at each of its longitudinal extremities for receiving one end of a spring means so as to retain the spring means in its desired location, the base further has a centrally located upstanding projection partially enveloping the two spring means and also is provided with a side wall having angularly and laterally disposed surfaces; a cap having pockets in its longitudinal extremities to receive and retain the other ends of the spring means, the cap having a pair of centrally located depending members which co-operatively interengage the projection of the base, the cap also being provided with a side wall having angularly and laterally disposed surfaces to co-operatively interengage similar surfaces on the base.

This improved apparatus has been found to provide substantial benefits. For example, the co-operative interengagement of the components of the base and cap noted above provides the desired restraint of lateral and longitudinal motion while permitting the requisite pitch and roll motions of the railroad car bolster. In addition, the co-operative interengagement of the base projection with the depending members of the cap effectively restricts the movement associated with car rocking. In this instance, the more effective envelope provided for the spring means of the present assembly minimizes the wear and tear on the components of the side bearing caused, for example, by excessive car rocking motion.

The coil springs and base and cap side walls are constructed and located so that the springs have substantial visibility at all times, thus allowing for proper inspection of these springs while the springs are in their installed location.

The spring envelope of the present invention has been greatly increased as compared to the prior art thereby permitting a reduction in stress and an increase in useful life. Other benefits of the present invention include, for example, a potential for improved securement to the truck bolster and ease of packaging for shipment.

These and other aspects and advantages of the present invention are set forth in the following detailed description and claims, particularly when considered in conjunction with the accompanying drawings in which like parts bear like reference numerals.

DESCRIPTION OF THE PREFERRED EMBODIMENT

Figure 1:
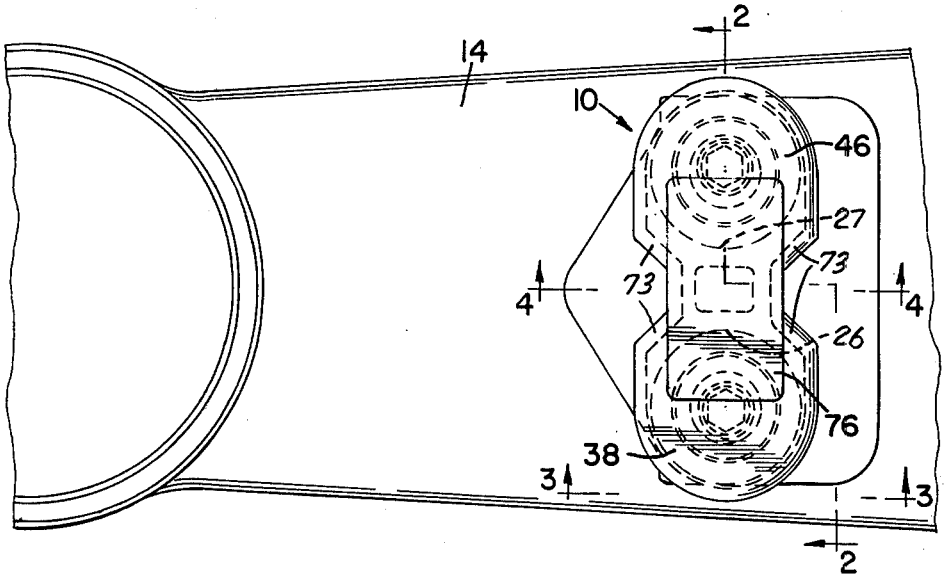
FIG. 1 is a detailed plan view showing the side bearing mounted on the truck bolster.

Referring now to the drawings in detail and in particular to FIG. 1, the side bearing assembly is shown generally as 10. The side bearing assembly 10 includes a base portion 12 which is attached to a truck bolster 14 by means of bolts 16 and 18 which pass through holes in the truck bolster 14 and are secured in place by nuts 20 and 22. It should be understood that even though the invention is illustrated as a separate assembly having a base portion or unit which can be bolted or riveted to the truck bolster, that part or unit of such an assembly may be cast as an integral part of the bolster.

When the side bearing assembly 10 is mounted upon the truck bolster 14, the longitudinal axis of the side bearing assembly 10 is perpendicular to the longitudinal axis of the truck bolster 14 and is parallel to the longitudinal axis of the railroad car.

Figure 2:
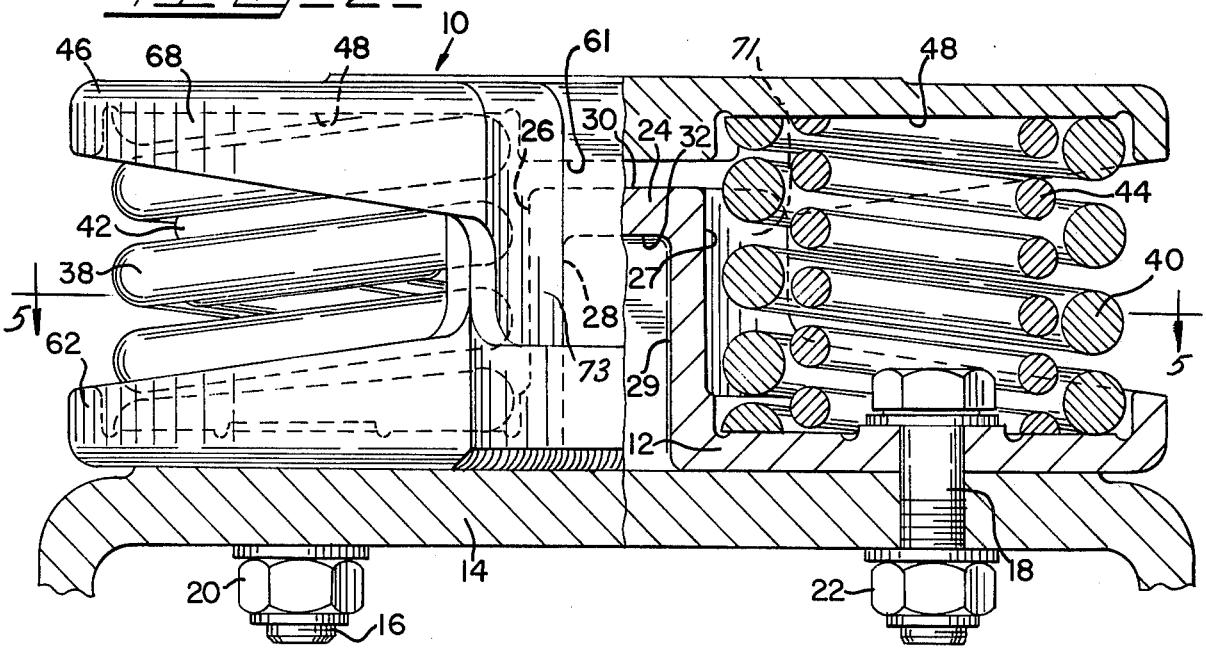
FIG. 2 is a partial sectional view taken on line 2—2 of FIG. 1.
Figure 3:
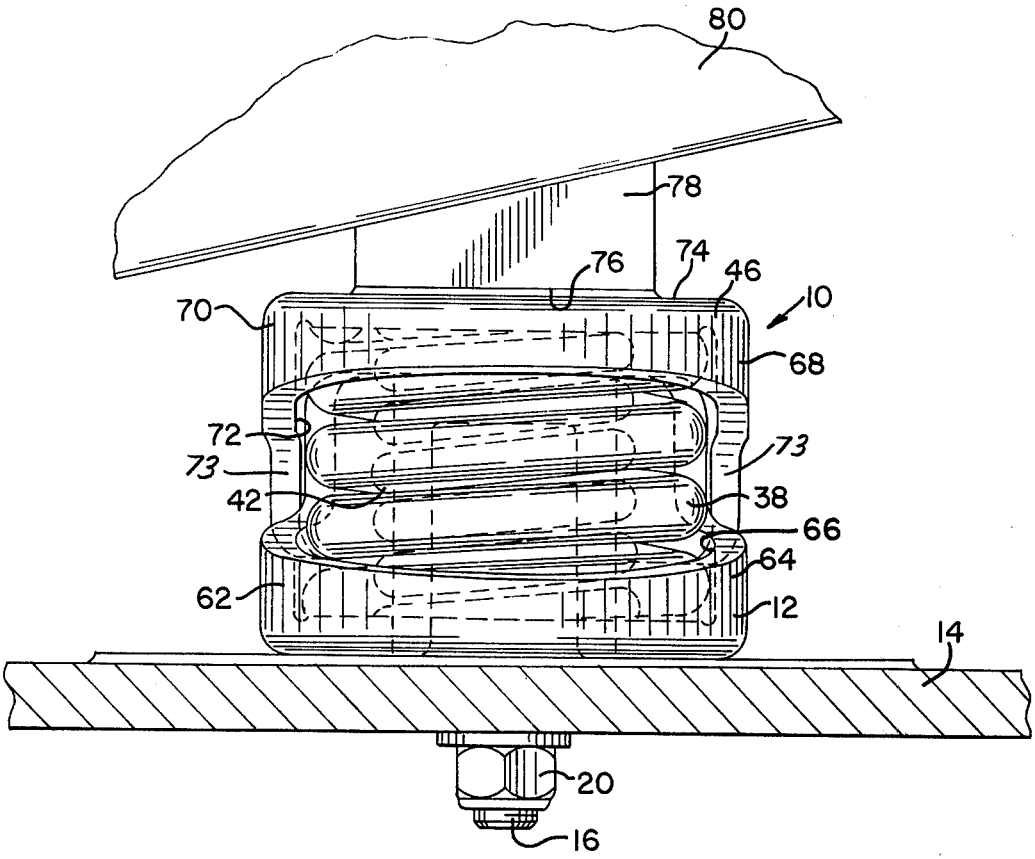
FIG. 3 is an elevation view taken on line 3—3 of FIG. 1.
Figure 4:
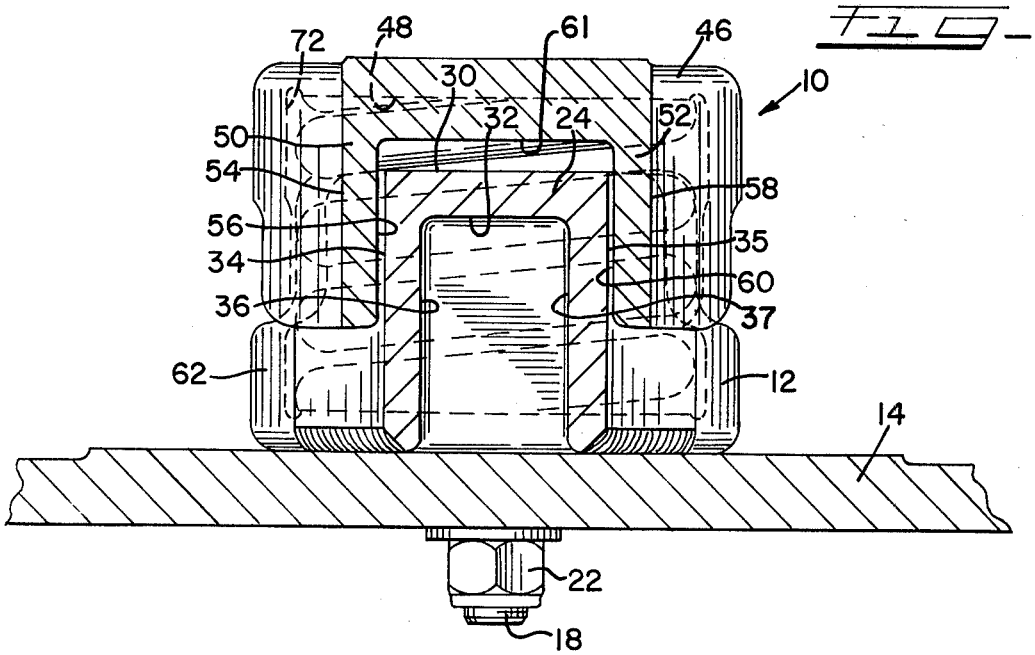
FIG. 4 is a sectional view, partly in elevation, taken on line 4—4 of FIG. 1.
Figure 5:
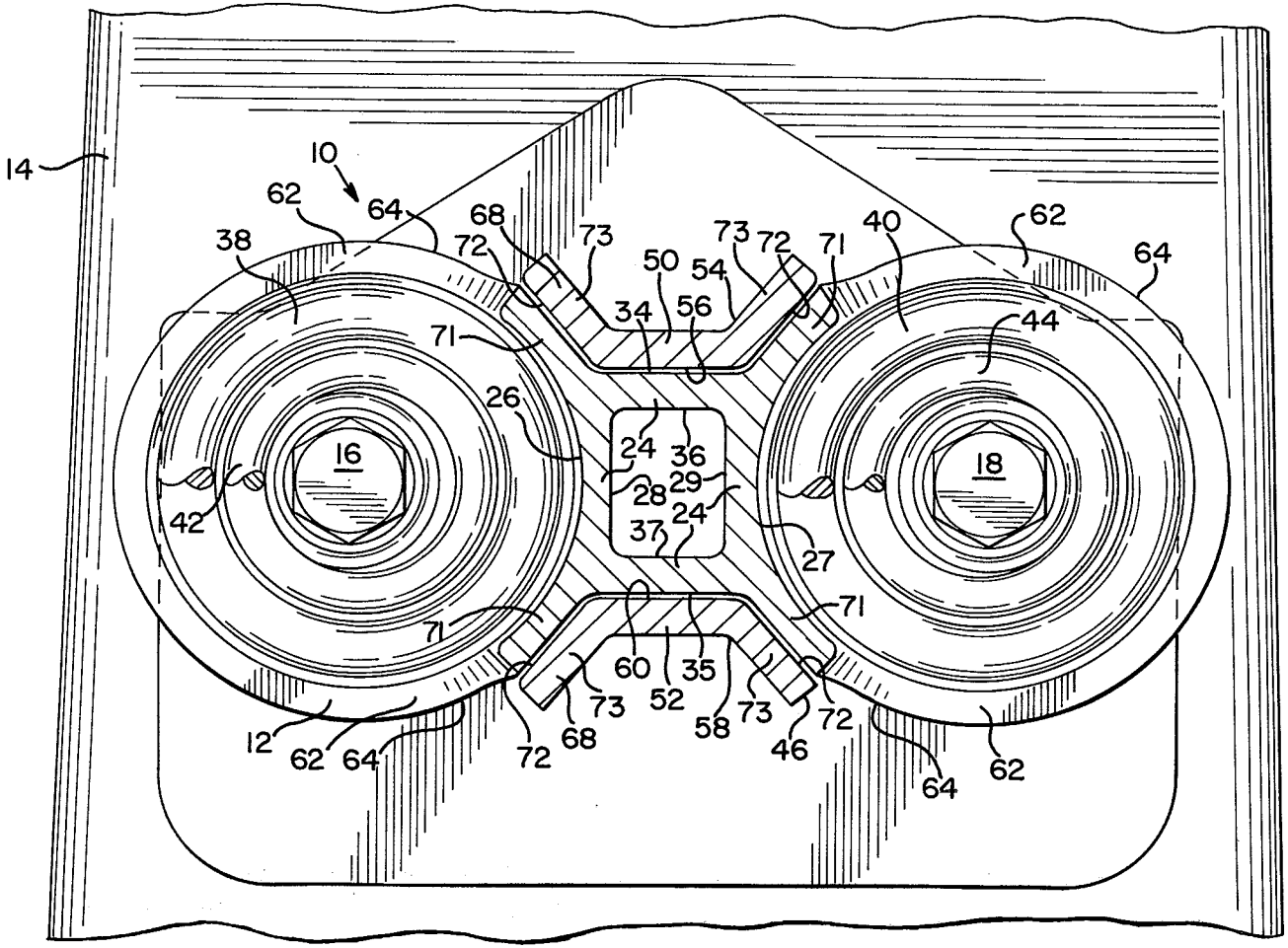
FIG. 5 is a cross-sectional plan view of the side bearing as seen generally along the line 5—5 of FIG. 2.

Base portion 12 includes a centrally located projection 24, which extends upwardly from truck bolster 14, as best seen in FIG. 2. Exterior sidewall surfaces 26 and 27 and interior sidewall surfaces 28 and 29 of the projection 24 are substantially perpendicular to truck bolster 14 with the exterior surfaces 26 and 27 having an arcuated configuration. An exterior top surface 30 and an interior top surface 32 of the projection 24 are substantially parallel to truck bolster 14. Referring to FIG. 4, the projection 24 also has an exterior front wall surface 34, an exterior rear wall surface 35, an interior front wall surface 36, and an interior rear wall surface 37, each of which surfaces are substantially perpendicular to truck bolster 14.

As shown in FIG. 2, two large coil springs 38 and 40, and two smaller concentrically oriented therein, coil springs 42 and 44 are mounted in pockets defined by the base portion 12 and are subject to vertical resilient movement as hereinafter described. One end of each of the springs 38, 40, 42 and 44 is retained by the base portion 12 and the other end engages a cap 46 at its lower inside surface 48.

The plurality of spring means, such as the springs 38 and 42 and the springs 40 and 44 has been found to substantially and unexpectedly prolong the life of side bearing assembly 10. The balanced resiliency of the present system appears to minimize or cushion the effect that continual stress has on the individual springs.

As best shown in FIG. 4, the cap 46 has a pair of centrally located downwardly extending front and rear elements 50 and 52, respectively. The element 50 has an exterior surface 54 and an interior surface 56. Similarly, the element 52 has an exterior surface 58 and interior surface 60. Each of these surfaces 54, 56, 58 and 60 extend downwardly from the cap 46 and are substantially perpendicular to the truck bolster 14. The interior surfaces 56 and 60 of the elements 50 and 52, respectively, co-operatively interengage the exterior front wall surface 34 and the exterior rear wall surface 35, respectively, of the projection 24 to aid in the functioning of side bearing 10, as described hereinafter.

Projection 24 co-operatively interengages with the cap 46 to avoid excessive compression of the springs 38, 40, 42 and 44 when, for example, severe up and down motion is encountered, which motion is associated with car rock. Thus, the exterior top surface 30 of the projection 24 is spaced sufficiently close to a lower inside surface 61 of the cap 46 so that the surfaces 30 and 61 contact each other prior to springs 38, 40, 42 and 44 being fully compressed. Such contacting prevents full spring compression and in this manner minimizes excessive force being placed on the springs 38, 40, 42 and 44.

The base portion 12 includes a peripheral sidewall 62 which, in turn, has an exterior surface 64 and an interior surface 66. The peripheral sidewall 62 of the base portion 12 has both angularly and laterally disposed edges, as shown in the drawings. Similarly, the cap 46 includes a peripheral sidewall 68 having an exterior surface 70 and an interior surface 72. The peripheral sidewall 68 also has both angularly and laterally disposed edges, again as can be seen in the drawings. The angularly and laterally disposed edges of peripheral sidewalls 62 and 68 are positioned with respect to each other so that the exterior surface 64 of an inner end portion or portions 71 of the base sidewalls 62 can co-operatively interengage the interior surface 72 of an inner end portion or portions 73 of the cap sidewalls 68. Note, the base inner end portion 71 is inwardly offset so as to join the projection 24 on an angle and that the cap inner end portion 73 joins the front and the rear elements 50 and 52 on a like angle.

Another feature of the present invention, as best shown in FIG. 2, is that the sidewalls 62 and 68 extend upwardly and downwardly, respectively, only a short distance at the longitudinal ends of side bearing assembly 10. The upward and downward dimension of the sidewalls 62 and 68, respectively, increase gradually as the center of the side bearing assembly 10 is approached. A substantial distance from the longitudinal ends of side bearing assembly 10 toward the center of side bearing assembly 10 is achieved prior to an overlapping of the sidewalls 62 and 68 occuring. Thus, substantial portions of each of the springs 38, 40, 42 and 44 are clearly visible and can be readily inspected. Again, this is possible because the peripheral sidewall 62 of the base portion 12 does not overlap the peripheral sidewall 68 of the cap 46 at either of the longitudinal ends of side bearing assembly 10.

A top surface 74 of the cap 46 frictionally engages a surface 76 of a wear plate 78 which is connected to a car body bolster 80. Thus, the frictional engagement of the cap 46 and the car body bolster 80 allow the car body and car truck to rotate with respect to each other along a vertical axis which is concentric with the interengaged center plate of the truck bolster 14 and the car body bolster 80. Side bearing assemblies 10 are positioned at respective ends of the respective truck bolster 14 and are in frictional engagement with opposing wear plates 78 and the car body bolster 80 so that during any motion of the car body, there is frictional pressure applied to the car body adjacent both ends of the truck bolster 14. Thus, the frictional engagement provides substantial control in the reduction of nosing and swiveling of the car truck while allowing the truck enough freedom to follow the track along a curve. When the truck is rotating with respect to the car along the vertical axis which passes through the center plates, the cap 46 on the side bearing 10 and the frictional wear plate 78 on the car body bolster 80 tend to move generally longitudinally while still allowing up and down movement of the cap 46 when required due to rocking of the car body. Throughout the turning operation, the downwardly extending front and rear elements 50 and 52 and the sidewall inner end portions 73 of the cap 46 in co-operation with the centrally located projection 24 and the sidewall inner end portions 71 of the base portion 12 provide proper centering of the cap 46 with respect to the base portion 12 and allow the springs 38, 40, 42 and 44 to operate substantially in the vertical direction.

Upon completion of the turn, the inner end portion 73 of the interior surface 72 of peripheral sidewall 68 of the cap 46 will be in contact with the inner end portion 71 of the respective exterior surface 64 of the peripheral sidewall 62 of the base portion 12. The particular point or points of contact, of course, will depend upon the direction of the turn and also the particular location of the side bearing 10. After completion of the turn, the balanced action of the springs 38, 40, 42 and 44 exert a centering force on the cap 46 and thus terminate all residual contact between the cap 46 and the base unit 12 until another turn is encountered. It has been found that the balanced action of the present plurality of spring means provides for more effective centering of the cap 46 relative to, for example, side bearings including only one unbalanced helical spring to minimize wear and tear on the components of the side bearing assembly 10, in particular, the base portion 12 and the cap 46.

The exterior surfaces 34 and 35 of the centrally located projection 24 are received in spaced relationship by the interior surfaces 56 and 60 of the downwardly depending elements 50 and 52 of the cap 46. This cooperative interaction between the exterior surfaces 34 and 35 and the interior surfaces 56 and 60 helps to maintain vertical orientation of the springs 38, 40, 42 and 44 during up and down motion of the cap 46 associated with car rock. Thus, proper orientation of the cap 46 is maintained with respect to the base unit 12 to restrict nosing and swiveling of the car truck. The side bearing assembly 10 shown in the drawings is typically used in combination with another side bearing assembly 10 mounted on the opposite end of the truck bolster 14.

While this invention has been described with respect to various specific examples and embodiments, it is to be understood that the invention is not limited thereto, and that it can be variously practiced within the scope of the following claims.

I claim:

1. A side bearing assembly for use with a railroad car truck having a truck bolster and a car body bolster of a railroad car supported thereby, said assembly comprising, two spaced spring means each having a selective width dimension less than one half of a width of said bolster, a base disposed for mounting to said truck bolster with the longitudinal axis of said base positioned substantially perpendicular to the longitudinal axis of said truck bolster and mounting means formed within said base and proximately aligned with said base longitudinal axis, said base having shallow pockets at each of its longitudinal extremities for receiving one end of one of said spring means respectively so as to retain said spring means within said base, said base further having a centrally located upstanding projection having a substantial cross-sectional area, and sidewalls about said base having angularly and laterally disposed surfaces partially enveloping said spring means, with inner end portions of said sidewalls joining said projection, a cap having shallow pockets at each of its longitudinal extremities for receiving an opposite end of one of said spring means respectively so as to retain said spring means within said cap, and a pair of spaced centrally located downwardly depending members which co-operatively interengage said projection of said base, said cap further being provided with sidewalls having angularly and laterally disposed surfaces with an inner end portion of said sidewalls joining said depending members to co-operatively interengage similar surfaces on said base during horizontal movement of said base with respect to said cap, wherein downward vertical movement of said cap is limited by engagement with said base projection, horizontal movements of said cap with respect to said base is limited by interengagement between said inner end portions of said side walls of said base and cap, and said angularly and laterally disposed surface of said base and cap side walls allow said spring means to remain readily observable for inspection purposes.

2. A side bearing assembly for a railroad car to cushion vertical movements and restrain horizontal movements between a body of said car and a truck bolster of said car, said assembly comprising, an assembly body, a lower portion carried by said body and prepared for selective attachment to said truck bolster, said lower portion having a flat elongated bottom, shallow upwardly protruding flanged circumferent ends integrally formed at ends of said bottom, upwardly inclined spaced side walls having outer ends joining with said flanged ends, and an upwardly projecting center hub having a substantial mass formed on said bottom and positioned to divide said lower portion into two spaced receiving areas with an inner end portion of said sidewalls joining said center hub, an upper portion carried by said body and spaced above said lower portion, said upper portion having a flat, elongated top having a top surface prepared to engage with said car body in a frictional sliding relationship, shallow downwardly protruding flanged circumferent ends integrally formed at ends of said top, downwardly inclined spaced side walls having outer ends joining with said flanged ends, a raised concussion element carried on a bottom surface of said upper portion and positioned to align with a top of said hub and dividing said top into two spaced covering areas, and spaced guiding elements projecting downwardly from said bottom surface on each side of said concussion element and connecting with inner end portions of said upper portion sidewalls, said guiding elements and said upper portion sidewalls positioned to receive therebetween said hub and said lower portion sidewalls and selectively engage said hub and said side walls of said lower portion and limit horizontal movements therebetween, and said concussion element of said upper portion to engage said center hub of said lower portions to limit downward movement of said upper portion, and a pair of dual spring elements one each disposed between said upper and lower portions in said receiving and said covering areas, wherein said shallow circumferent ends of said inclined side walls of said upper and lower portion being spaced apart to allow observation of the condition of said spring element.

3. A side bearing assembly of claim 2 wherein said inner end portions of said lower portion sidewalls and said inner ends of said upper portion sidewalls being inwardly offset to join said concussion element and said spaced guiding elements on an angle.

4. A side bearing assembly particularly adapted for assembly to a railroad car truck bolster having preformed mounting means on said bolster limited to two pair of spaced holes, one each of said pair of holes located near an end of said bolster and a line joining centers of each hole pair positioned parallel to a longitudinal axis of said car truck, said assembly comprising, an elongated base having spaced rounded ends and spaced holes located on a longitudinal axis of said base, said holes aligning with said bolster hole mounting means and prepared to receive a fastening device therein to secure said base to said bolster, said base having a length less than a width of said bolster at said preformed mounting means, a projection centrally located on said base and having a flat horizontal top surface and a front and rear vertical sidewall positioned proximately parallel to said longitudinal axis and exterior sidewall surfaces having an arcuated configuration to provide said projection with a substantial cross-sectional area, and sidewalls formed about said rounded ends to provide in part a shallow retaining area, said sidewalls extending inwardly and upwardly toward said projection and including an inner end portion inwardly offset to join said projection on an angle with a height of said inner end portion proximating a height of said projection, and an elongated cap having rounded ends and a length proximating said base length, a front and rear element centrally located and formed on an underside of said cap, said elements each having an inner surface having a height proximating a height of said base projection and spaced to receive said projection therebetween with said inner surface being adjacent to said front and said rear vertical sidewalls of said projection, and sidewalls formed about said rounded end to provide in part a shallow covering area, said sidewalls extending inwardly and downwardly toward said elements and including an inner end portion inwardly offset to join said element on an angle with a height of said inner portion proximating a height of said element, said inner portion of said cap sidewalls receiving therebetween said inner portion of said base sidewalls, and spring means disposed between said base and said cap and in said receiving and covering areas, said means having a compressed height less than said height of said projection, wherein downward movement of said cap is resisted by said spring means and limited by engagement with said projection and said projection front and rear sidewalls and said inner end portions of said base sidewalls resisting horizontal movement of said cap by engaging adjacent surfaces of said cap.

* * * * *